United States Patent [19]

Busker et al.

[11] 4,157,236

[45] Jun. 5, 1979

[54] ELECTROSTATIC DRY FORMER

[75] Inventors: Leroy H. Busker, Rockton, Ill.; Henry P. Sheng, Youngstown, Ohio

[73] Assignee: Beloit Corporation, Beloit, Wis.

[21] Appl. No.: 772,753

[22] Filed: Feb. 28, 1977

[51] Int. Cl.[2] ..... B29C 23/00

[52] U.S. Cl. ..... 425/174.8 E; 19/296; 264/26; 425/224; 425/232; 425/363

[58] Field of Search ..... 156/62.2, 62.4; 264/24–26; 425/174.8 R, 174.8 E, 197, 200, 505, 217, 224, 230, 232, 447, 449, 471, 3, 363; 19/296; 427/13, 14

[56] References Cited

U.S. PATENT DOCUMENTS

| | | | |
|---|---|---|---|
| 2,116,942 | 5/1938 | Formhals | 425/174.8 E X |
| 3,864,066 | 2/1975 | Gerhardt | 425/224 X |

FOREIGN PATENT DOCUMENTS

| | | | |
|---|---|---|---|
| 648410 | 9/1962 | Canada | 19/296 |
| 9232 | 3/1972 | Japan | 19/296 |

*Primary Examiner*—Roy Lake
*Assistant Examiner*—Mark Rosenbaum
*Attorney, Agent, or Firm*—Dirk J. Veneman; Michael L. Gill; Gerald A. Mathews

[57] ABSTRACT

A method and apparatus for dry forming a paper, or other nonwoven web, from fibers or fiber flocs. The flocs or bundles are exposed to an oscillating electrostatic field, the resultant mechanical agitation shakes individual fibers loose, which then fall through a screening wire onto a moving forming wire. At a station downstream from the forming section a binder is applied. After appropriate conditioning, the newly formed web is picked off for further processing.

11 Claims, 3 Drawing Figures

ELECTROSTATIC DRY FORMER

BACKGROUND OF THE INVENTION

The present invention relates to a method and apparatus for producing a dry formed web from fibrous material. Both paper and nonwoven webs may be produced by this dry forming process. Dry forming can result in significant energy savings when compared with conventional wet forming systems. Wet formed webs are produced by mixing fibers with water to form a slurry and laying this slurry on a forming wire. The water is then removed from the newly formed web by mechanical and thermal means. Typically, it will take 100 tons of water to make one ton of paper. A great amount of energy is required both, to pump this water, and to heat dryers to remove residual water. Further energy is required to treat waste water before it is discharged. Present concern over energy conservation and water pollution has caused attention to be focused on energy efficient, "dry" paper formation processes.

In typical prior art dry forming processes, air is substituted for water as the carrying fluid. Many formers have been built in which fibers are carried by a turbulent air flow to a forming wire, where they are disposited. Usually a vacuum box is placed below the forming wire to suck air through the wire. The vacuum assists in the formation of the web and also collects the fines and fibers which pass through the forming wire. The air, fibers and fines collected by the vacuum means are then usually recirculated to an entrainment zone where "white air" from the forming process is mixed or blended with fibers from a classifier or defiberizer.

The newly formed web is then processed further. Further treatment is quite arbitrary and depends on desired sheet characteristics as well as the properties of the starting material. Typical treatment to consolidate the web includes embossing, pressing, and binding. After these processing steps, the web is a coherent and mechanically stable product.

Another prior art forming arrangement is taught by Kroyer U.S. Pat. No. 3,575,749. It is known, for example, that an electrostatic potential can be used to deposit fiber or binder on a moving band. The fiber or binder receives a charge of one polarity and the band receives a charge of the opposite polarity. In this prior art arrangement, there exists an attraction between the fibers or binder and the surface upon which it is to be deposited. The drawback of such an arrangement it that the web formed is not uniform.

SUMMARY OF THE INVENTION

The process according to the present invention is characterized by the delivery of dry fibrous bundles or flocs to an agitation zone. This zone is bounded by, and defined by, a plate electrode as a roof element, and a porous screen or wire for a floor element. The mechanical agitation is accomplished by developing an oscillating electrostatic field within this zone. The dry flocs acquire a charge and migrate across this zone. It has been observed that individual flocs may acquire a charge of unlike polarity. This results in a cross migration of flocs. The collisions caused by this cross migration results in very efficient defiberization of the flocs. The flocs also collide with the plate electrode roof and screening wire floor of the zone. This also results in defiberization of the flocs. It is also apparent that on occasion only one end of a fiber or floc may acquire a charge. This causes a rotation of the flocs or fiber bundles as they migrate across the defiberization zone. The combination of floc rotation and cross migration results in a very efficient defibering process. However, on occasion a floc may resist defiberization and a device for the removal of intact flocs is provided at the downstream end of defiberization zone.

The individual fibers which pass through the screening wire are at ground potential and they fall onto the forming wire below the screening wire. The free fibers assume their natural shape as they fall, which means some are curly, some straight. This results in a random cross-linked web which is isotropic. The fibers are also deposited uniformly in the cross-machine direction.

A vacuum box or chamber arranged below the forming wire also coacts with the forming wire to enhance the uniformity of the web. If there is a "bare" spot on the wire, the air flow will be greater through the thin area. This greater air flow carries with it entrained fibers and thus effectively fills in the thin area. This forming process results in a more uniform web than can be produced by conventional air laid system or by a conventional electrostatic process.

After forming, it may be desirable to lightly moisten and compact the web to further consolidate it. The post formation treatment of the web is arbitrary and depends on the desired sheet properties which is readily apparent to those skilled in the art. Post treatment may include, but is not restricted to the addition of bonding agents, such as starch or latex rubber followed by such operations as sizing, coating, calendering, trimming and winding.

The apparatus for conducting this process may take any one of several forms. A practical arrangement may include a moving screening wire loop and a forming wire loop in spaced apart relation. Screened fibers would pass through the screening wire and traverse the gap formed between the two wires. Web formation is accomplished on the lower or forming wire, and is assisted by a vacuum box or zone which draws air from the forming gap through the forming wire. This air contains fines and fibers and after suitable cleaning in a cyclone separation, or other device, the clean air is exhausted to the atmosphere.

The fiber flocs may be fed to the defiberization zone through any suitable conveyor means. Once the flocs are in the defiberization zone, they are subjected to an oscillating electric field. This results in mechanical agitation of the flocs and separation of individual fibers which travel through the screening wire to the forming gap. A suitable vacuum device is present at the downstream end of the defiberization zone to remove intact flocs. These may be recirculated to the upstream end of the defiberization zone after passage through a hammer mill, or other suitable defiberization or refining means.

It is also advantageous to provide a cleaning device within the screening wire loop. Occasionally, a floc may adhere to the wire and if it is not removed, it will lower screening efficiency and may also impair web uniformity. A stiff rotary brush flanked by vacuum boxes is one suitable arrangement for cleaning the screening wire.

In another possible arrangement, the screening wire may take the form of a rotating drum with a semicircular electrode plate supported within it. The volume trapped between the electrode and the inner surface of the drum is the screening zone. Flocs which are adhered to the drum's inner surface are blown back into the hopper, which feeds flocs to the screening gap. Suitable wire cleaning devices may incorporate an air cap to blow the adhered flocs back into the hopper.

These two geometries are only two of the many possible arrangements and are included by way of illustration. They should not be construed as the limits of this invention since other embodiments will be obvious to those skilled in the art.

DETAILED DESCRIPTION OF PREFERRED EMBODIMENT

Figure 1:
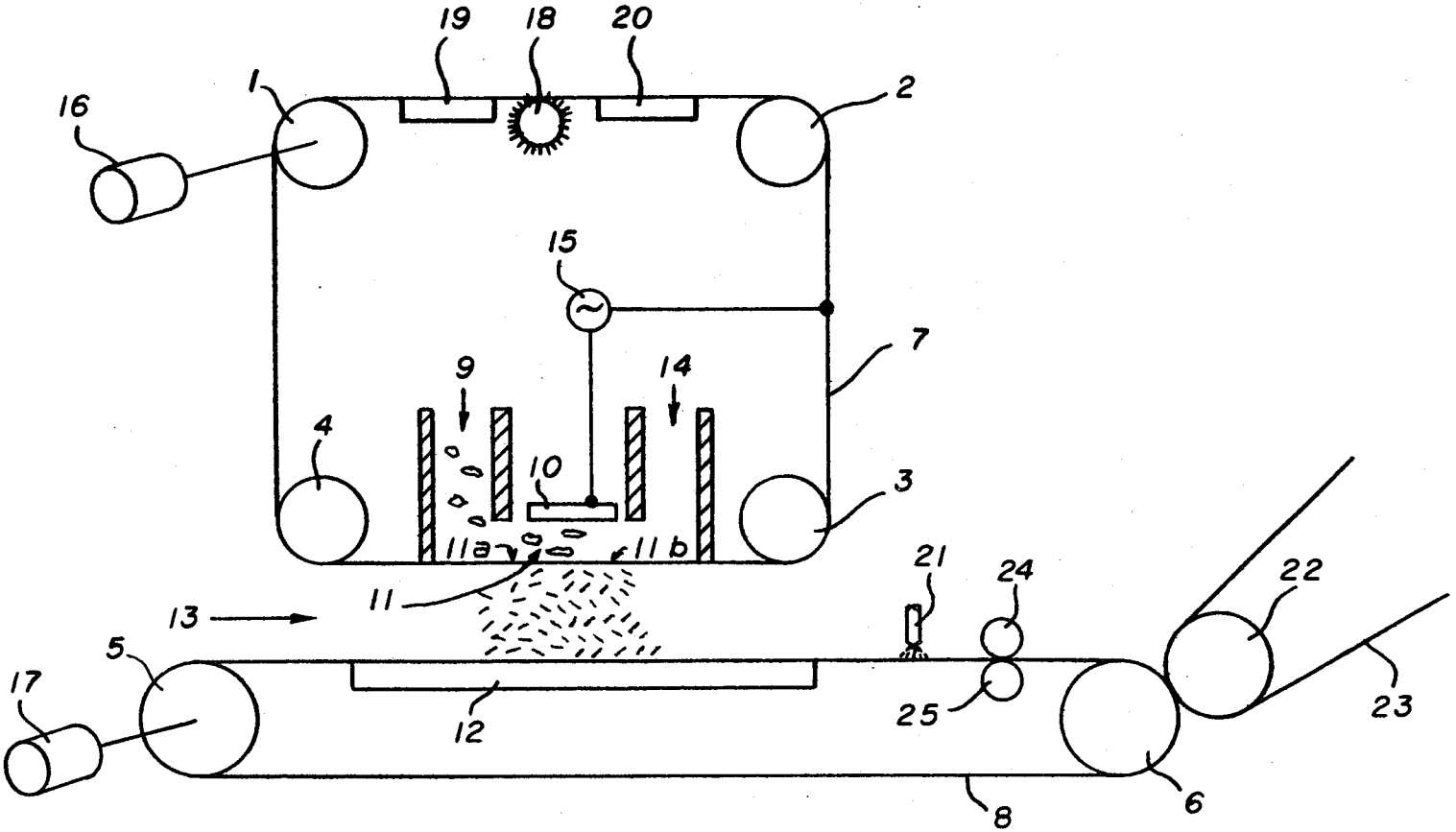
FIG. 1 is a schematic elevational view of the preferred embodiment of the invention.

FIG. 1 shows the instant invention in combination with ancillary equipment for binding and pressing the web and for picking off the completed web at the end of the forming area.

Support rollers 1, 2, 3 and 4, are arranged to support the screening wire loop 7. While support rollers 5 and 6 support forming wire loop 8, a portion of the screening wire loop 7 is paralleled and horizontal to a portion of the forming wire loop 8. The gap which is formed between the two parallel runs of wire is the forming gap 13.

Within the screening wire loop, a metal electrode plate 10 is arranged to form a horizontal screening gap 11, between the electrode 10 and the screening wire loop 7. This screening gap is fed fiber flocs from a feed hopper 9 at its upstream end. The spacing of this gap is not critical, but is typically 1 to 3 cm. The optimum size is determined by the average floc size. With flocs of 0.5 cm. to 1 cm. in diameter, optimum gap spacing is approximately 1.6 cm.

A generating device 15, is included to provide a source of oscillating voltage. This device is connected between the electrode plate and ground potential. In operation, it will alternately charge the electrode plate positively and negatively. The high voltage generator should advantageously develop a field strength of between 8,200 volts to 11,000 volts per centimeter of gap spacing.

The electrode plate should be coated with a dielectric material to reduce the chances of arc over and sparks discharge within the screening gap. Any conventional dielectric material can be used. Polyethylene, for example, has a dielectric strength of 50 kilovolts per millimeter and a small thickness of just a few millimeters would provide adequate protection against arcing and breakdown. It is understood that the electrode plate and plates called for in this invention include metal plates coated with a sufficient thickness of a dielectric material to ensure that at the operating voltage of the device there is no possibility of arc over or dielectric breakdown. The dielectric material will be chosen primarily on the basis of cost, and the thickness of dielectric material will depend upon the dielectric constant of the material chosen and the field strength which is desired in the screening gap. The optimum field strength within the gap is chosen with regard to the properties of the fiber flocs used in this invention.

Since the fiber flocs which are delivered to the former are dry, the aggregate of fibers in the screening gap is a very poor electrical conductor. The fiber flocs do acquire some charge which is transported to ground potential in the screening gap so there is some current associated with the fiber movement and some power dissipated by this process. However, the process is conceived of as being essentially electrostatic with very low power consumption.

The screening wire loop 7 is driven in a continuous fashion by conventional drive means 16. Motion imparted to the screening wire causes the fiber flocs present in the screening gap 11 to move from the upstream end of the screening gap 11*a* to the downstream end of the screening gap 11*b*. Typically, the screening wire will move more slowly than the forming wire and a typical transit time for a floc is approximately ½ to 5 minutes.

The optimum speed of the screening wire depends on a variety of factors. The objective is to produce an efficient screening process. This requires that the screening wire not move so slowly that it is completely free of fiber flocs and fibers at the downstream end of screening gap. A bare screening wire at the downstream end of the screening gap is not making effective use of the electrode plate toward the downstream end of the screening gap. Likewise, screening efficiency drops off if the screening wire moves so fast that virtually all the fiber flocs present at the upstream end of the screening gap are still present and intact at the downstream end of the gap. The actual optimum screening wire speed is most easily determined experimentally. Generally, the best screening wire speed is the one which develops the greatest basis weight web for a given forming wire speed.

Basis weight control of the web depends on a number of factors as well. These include generator frequency, forming wire loop speed, screening wire loop speed, the vacuum present in forming gap vacuum box, and the effectiveness of the screening wire cleaning devices. Generally, either forming wire speed or screening wire speed will be used to control basis weight.

Fiber flocs which remain in the screening gap at the downstream end are removed by a vacuum doctor 14. Flocs which are picked up by vacuum means can be recirculated to the feeding hopper after treatment by a suitable defiberizing device. The actual type of defiberizing device would be determined by the nature of the fibrous material as is apparent to those skilled in the art.

Within the screening wire loop is a wire cleaning device. It has been found that flocs which adhere to the screening wire reduce the efficiency of the screening process. It is, therefore, desirable to remove them. One way to accomplish this task is to draw a vacuum with suction boxes 19 and 20 located on the inside of the screening wire loop. These act to draw air through the wire and thus draw flocs from the working surface of the wire. A brush 18 is also useful to help dislodge flocs when coacting with suction boxes.

Charge is acquired by the fiber flocs both by contact with the walls and by electrostatic induction. Charged flocs within the screening gap are agitated by the action of the electrostatic field generated by generator 15. This action knocks individual fibers loose. Loose fibers fall through the screening wire into the forming gap 13. Here they are subjected to currents of air induced by the action of a forming zone vacuum chamber 12 located under the forming wire. This vacuum chamber may extend for a considerable distance beyond the screening gap. The length is determined by a number of factors and may vary typically between one to four meters. Factors governing the length of the chamber include fiber type, forming gap height, suction in the forming zone vacuum box and forming wire speed. The optimum value of this parameter will be determined by experiment.

The objective of this extended vacuum zone is to further consolidate the web.

After the web is formed, it is moved to stations downstream of the forming gap 13 by the action of forming wire drive means 17. In many nonwoven applications, a binder is added to the web, a typical device is shown as spray unit 21. Usually, light pressing or embossing follows the addition of a binder. Such a step is shown schematically by press rolls 24 and 25. After the web is mechanically stable, it is picked off in any conventional manner for further processing. A pick-up roll 22 and its associated pick-up wire 23 are shown at a downstream location.

Figure 2:
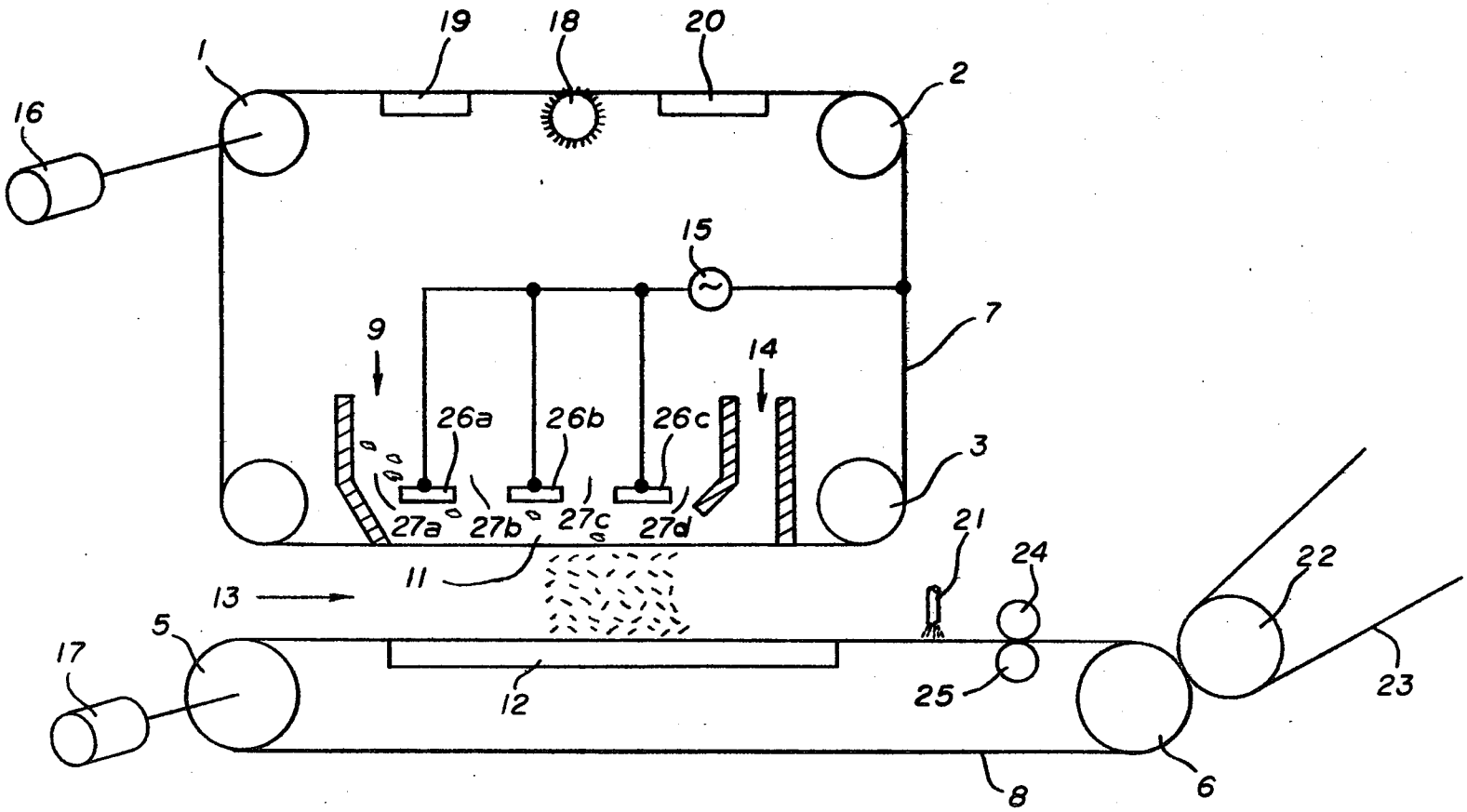
FIG. 2 is a schematic elevational view of an alternate form of the defiberization zone.

In some applications where either a high basis weight is desired or a compact forming section is required, it will be found advantageous to employ a segmented electrode device as shown in FIG. 2. In this type of arrangement, flocs will be fed to the screening zone through the interstices between the electrode elements. A practical arrangement is achieved by supporting a screening wire loop 7 on suitable support rolls 1, 2, 3, 4. A multiplicity of electrodes *26a, 26b, 26c* are supported in spaced horizontal relation with the screening wire loop 7. The feed areas between adjacent electrodes are labeled *27a, 27b, 27c* and they permit flocs from feed hopper 9 to pass into the screening gap 11. A vacuum doctor 14 is provided at the downstream end of the screening gap to pick up flocs and recirculate them. A generator device 15 is provided to charge the electrode plates and is electrically connected between the electrode plates and the screening wire. The fibers freed by the agitation in the screening gap fall through the screening wire into the forming gap 13. The forming wire and its associated equipment operates as related in the description of the embodiment depicted in FIG. 1.

Figure 3:
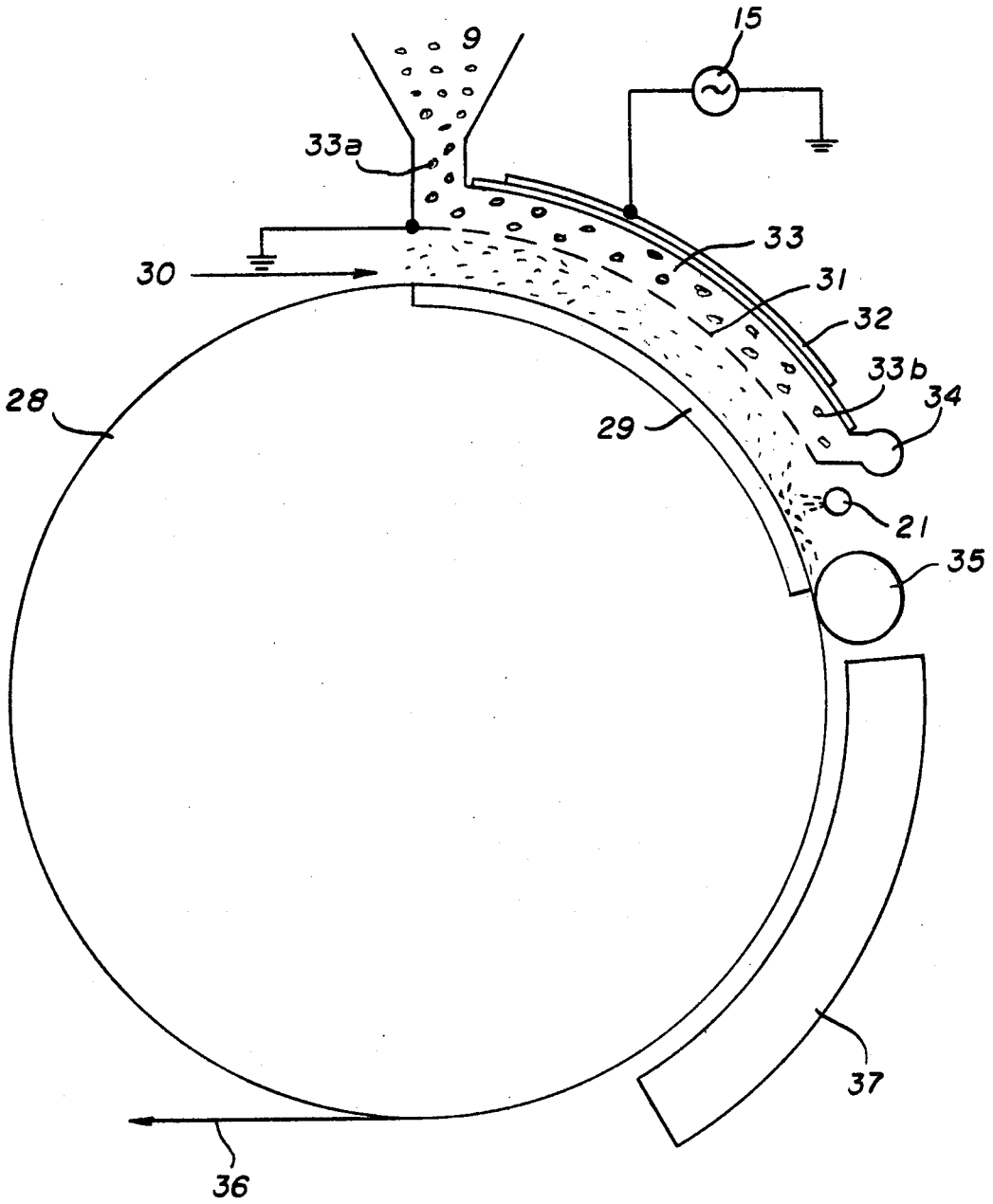
FIG. 3 is a schematic elevational vein of an alternate embodiment of the invention.

In applications where a rotary former is desired, the invention may take the form of FIG. 3. Here a rotating forming drum 28 is provided. A forming zone vacuum chamber 29 is provided on the interior of the forming drum. The volume above this forming zone vacuum chamber is designated 30 and is the forming zone. This zone is bounded on its upper surface by a curved stationary screening wire 31. A curved electrode plate 32 is also provided. The volume between the curved screening wire and the electrode plate form a screening gap 23. A hopper 9 is provided at the upstream end *33a*, the screening gap to feed fiber flocs to the screening zone. At the downstream end *33b* of the screening gap, a vacuum doctor 34 is provided to remove intact flocs. A binder may be applied if desired by a spray unit 21. Light pressing may be provided if desired by a press roll 35. Further processing may be applied to the web 36 before it is removed from the forming drum.

A radiant dryer is shown as 37, which may be advantageously used to cure a resinous binder applied by spray unit 21.

What is claimed is:

1. An apparatus for forming a web from fiber flocs comprising, in combination:

a screening member having inside and outside surfaces;

means operatively associated with the inside surface of the screening member for depositing fiber flocs on the screening member;

means operatively associated with the inside surface of the screening member for generating an oscillating electrostatic field around the screening member for mechanically agitating the fiber flocs to remove individual fibers therethrough;

a forming member spaced apart relative to the outside surface of the screening member and positioned to receive individual fibers passing through the screening member; and means operatively associated with the forming member for attracting thereto the individual fibers removed through the screening member to thereby facilitate the dry formation of a uniform, nonwoven web.

2. The apparatus of claim 1, wherein:

said screening member comprises an endless screening wire loop; and further including, means operatively associated with the screening wire loop for supporting the screening wire loop for movement thereabout; and means operatively associated with the screening wire loop for providing continuous movement to the screening wire loop.

3. The apparatus of claim 2 wherein said means for generating an electrostatic field around said screening member comprises:

a segmented electrode plate;

means for supporting said electrode plate in spaced apart relationship within said endless screening wire loop thus forming a screening gap with an upstream and downstream end; and means for generating an alternating electric voltage connected between said screening wire and said segmented electrode plate such that an electrostatic field is created in the screening gap.

4. The apparatus of claim 2 further comprising:

means for cleaning the screening member.

5. The apparatus of claim 4 wherein said means for cleaning said screening member comprises:

at least one vacuum box;

a brush roll; and means for supporting said vacuum box and said brush roll in adjacent positions on the inner periphery of the screening member.

6. The apparatus of claim 1, wherein:

said screening member comprises a rotatably mounted, perforated screening drum having means operatively associated therewith for rotatably turning the screening drum.

7. The apparatus of claim 6 wherein said means for generating an electrostatic field around said screening member comprises:

an electrode plate;

means for supporting said electrode plate in spaced apart relationship within said endless screening wire loop thus forming a screening gap with upstream and downstream ends; and means for generating an alternating electric voltage connected between said screening wire and said electrode plate such that an electrostatic field is created in the screening gap.

8. The apparatus of claim 7 further comprising:

a vacuum doctor; and means for supporting said vacuum doctor at the downstream end of said screening gap for removing fiber flocs from said screening member.

9. The apparatus of claim 6, wherein:

said forming member comprises an endless, looped forming wire, and having means operatively associated therewith for supporting the forming wire;

means operatively associated with the looped forming wire for moving the forming wire; and said means for attracting the individual fibers to the forming wire comprises a vacuum chamber located on a side of the forming wire opposite the side on which the fibers are forming the web.

10. The apparatus of claim 9 which further comprises:

means for depositing a binder onto said web at a position downstream of said forming member.

11. The apparatus of claim 9 which further comprises:

means for pressing and compacting said web at a position downstream of said forming member.

* * * * *